US006276541B1

(12) United States Patent
Gevaudant

(10) Patent No.: US 6,276,541 B1
(45) Date of Patent: Aug. 21, 2001

(54) DEVICE FOR SIMULTANEOUSLY UNFOLDING OR FOLDING CRANE JIB TIP ELEMENTS

(75) Inventor: Olivier Gevaudant, Charlieu (FR)

(73) Assignee: Potain, Ecully (FR)

( * ) Notice: Subject to any disclaimer, the term of this patent is extended or adjusted under 35 U.S.C. 154(b) by 0 days.

(21) Appl. No.: 09/502,040

(22) Filed: Feb. 11, 2000

(30) Foreign Application Priority Data

Feb. 26, 1999 (FR) ..... 99 02657

(51) Int. Cl.[7] ..... B66C 23/34
(52) U.S. Cl. ..... 212/300; 212/225
(58) Field of Search ..... 212/300, 261, 212/262, 263, 295

(56) References Cited

U.S. PATENT DOCUMENTS 2,573,528 * 10/1951 Woodslayer et al. ..... 212/300

FOREIGN PATENT DOCUMENTS

3433117 * 3/1986 (DE) ..... 212/300
331856 * 9/1989 (EP) ..... 212/300
414646 * 2/1991 (EP) ..... 212/300
473518 * 3/1992 (EP) ..... 212/300
536060 * 4/1993 (EP) ..... 212/300
0 733 584 A1 9/1996 (EP) .
665620 * 7/1964 (IT) ..... 212/300

* cited by examiner

*Primary Examiner*—Thomas J. Brahan
(74) *Attorney, Agent, or Firm*—Oliff & Berridge, PLC

(57) ABSTRACT

The device applies to a tower crane jib comprising a succession of elements articulated one to the next, comprising at least two relatively long main elements, and two relatively short tip elements. Connecting members, particularly in the form of a link-rod system, connect the front part of the last main jib element, the intermediate jib tip element and the end jib tip element in such a way that the two tip elements can be unfolded or folded simultaneously, in a vertical plane, relative to the remaining part of the jib. This device is actuated using the crane's lifting cable. In the folded position, at least one of the tip elements runs in a direction approximately perpendicular to the main elements.

10 Claims, 5 Drawing Sheets

DEVICE FOR SIMULTANEOUSLY UNFOLDING OR FOLDING CRANE JIB TIP ELEMENTS

BACKGROUND OF THE INVENTION

The present invention relates to tower cranes in which the jib, made as several successive elements articulated together, can be folded so that the crane can be transported, particularly by road. More specifically, the invention is aimed at crane jibs which, toward their tip, have two relatively short elements. The invention relates still more specifically to a device for simultaneously unfolding or folding such crane jib tip elements.

DESCRIPTION OF THE PRIOR ART

Cranes are already known in which the jib includes a relatively short tip element. By way of example, reference may here be made to a certain crane HD 32A marketed since 1993 by POTAIN, the erection and dismantling instructions for which crane describe the method of folding and unfolding the jib tip element. The folding of this jib element, which is motorized by two lateral gas springs, takes place in the vertical plane of the crane runway, and the jib tip element is immobilized in the work position by two connecting rods working in tension. The gas springs are used for unfolding the jib tip element, whereas this element is folded manually. The jib tip element is immobilized in the folded position using straps.

This known system allows just one jib tip element, of a length not exceeding two meters, to be folded. Moreover, this known system requires special motorizing.

Elsewhere, there exist systems for unfolding/folding a jib tip in a horizontal plane. A system of this kind requires, for unfolding and folding the jib tip, a ground space which is often incompatible with the space available on the site where the crane is being used. This is particularly true when the crane is being dismantled, or when the crane is installed a short distance from a building which it has constructed. This system, also, requires special motorizing.

The present invention sets out to avoid the drawbacks of the existing systems, mentioned hereinabove, by supplying a technical solution which is suited to crane jibs of the kind concerned here, and which allows:

- the crane and particularly its jib to be transported in a minimum amount of space that complies with the road-going gage width stipulated in official regulations, while at the same time maximizing the useful length of the jib in the work position;
- the crane to be erected and dismantled in a minimum lateral amount of space;
- simple and economical implementation, in particular avoiding any special motorizing.

SUMMARY OF THE INVENTION

The subject of the invention is a device for folding or unfolding tower crane jib tip elements, the jib comprising a succession of elements articulated one to the next about horizontal axes, these elements comprising at least two relatively long main elements, and at least two relatively short tip elements, the device being essentially one wherein connecting members are provided connecting the front part of the last main jib element, the intermediate jib tip element and the end jib tip element in such a way that the two tip elements can be unfolded or folded simultaneously, in a vertical plane, relative to the remaining part of the jib, at least one tip element being foldable in a direction approximately perpendicular to the main elements, this device being motorized by the crane's lifting cable and for this purpose comprising an unfolding arm borne by the front part of the last main jib element, and fitted with a pulley over which the lifting cable can pass during the operations of unfolding or of folding the jib tip elements, the lifting cable then being attached to one of said tip elements.

In order to perform these operations of unfolding or folding the jib tip elements, the lifting cable is, for example, attached to a shackle at the front end of the end jib tip element.

Advantageously, the aforementioned connecting members comprise at least one link-rod system located in a vertical plane and connected by articulations about horizontal axes to, respectively, the two tip elements and the front part of the last main jib element. The device may comprise two symmetric link-rod systems, arranged one on each side of the jib in parallel vertical planes.

Each link-rod system for simultaneously unfolding or folding the two jib tip elements, comprises, in one embodiment, a three-point lever articulated by its intermediate point to a top of the intermediate jib tip element, a front connecting rod articulated by one end to the front point of the lever and, by its other end, to the end of the jib tip element, and a rear connecting rod articulated by one end to the rear point of the lever and, by its other end, to the front part of the last main jib element.

Advantageously, the lever and one of the connecting rods of each link-rod system comprise respective holes which come into alignment when the jib tip is in the unfolded position, and which are designed for locking using a pin which immobilizes the lever with respect to this connecting rod and which consequently immobilizes the entire link-rod system in the aligned position. Thus stiffened, the link-rod system acts as a tie rod, when the crane is in the work position, with respect to the two jib tip elements. This link-rod system can also act as triangulation for the jib unfolded on the ground, which is also one possible position for transport on site.

As a preference, the unfolding arm is articulated about a horizontal axis to the front part of the last main jib element and includes stop and/or locking means for stopping it in the deployed position of use and in the position in which it is folded up against this main jib element.

In one embodiment, the device that is the subject of the invention also comprises a sling fixed to the front part of the end jib tip element and is designed to be attached to the rear end of the first main jib element when this jib is entirely folded. This arrangement applies more specifically to instances in which, if the crane is in the folded transport position, the intermediate jib tip element is approximately vertical and points downward, whereas the end jib tip element is oriented obliquely, pointing upward, in which case it lies near the rear end of the first main jib element also known as the "jib root".

In the latter instance, in particular, the device is also motorized by a ram used for the overall unfolding/folding of the jib, particularly a ram associated with an intermediate folding element inserted between two main elements of the jib. By virtue of this ram, the last main jib element can be inclined slightly and raised so as to bring the jib tip elements clear of the rear end of the jib root. This allowing the sling to be disconnected and the tip elements unfolded without these elements encountering any obstacle.

Overall, the folding or unfolding device that is the subject of the present invention offers the following advantages:

This device allows the two jib tip elements, which elements may have a combined length of the order of 3300 mm, to be folded in an available height of the order of 2100 mm, while at the same time respecting the standardized overall gage width for road transport, particularly by semitrailer.

Two jib tip elements are unfolded or folded simultaneously, which allows the number and duration of operations to be reduced.

Unfolding or folding is performed using motorizing systems which already exist for other functions (lifting cable, ram for the overall unfolding/folding of the jib), and thus without calling for special motorizing.

The operations of unfolding and of folding the jib tip elements do not require manual interventions that involve a significant amount of effort.

Finally, these unfolding and folding operations become achievable in a minimum lateral amount of space which is brought down to the width of the points via which the crane rests on the ground.

BRIEF DESCRIPTION OF THE DRAWINGS

The invention will be better understood with the aid of the description, which follows, with reference to the drawings which, by way of example, depicts one embodiment of this device for simultaneously unfolding or folding crane jib tip elements.

DESCRIPTION OF THE PREFERRED EMBODIMENT

Figures 1A, 1B:
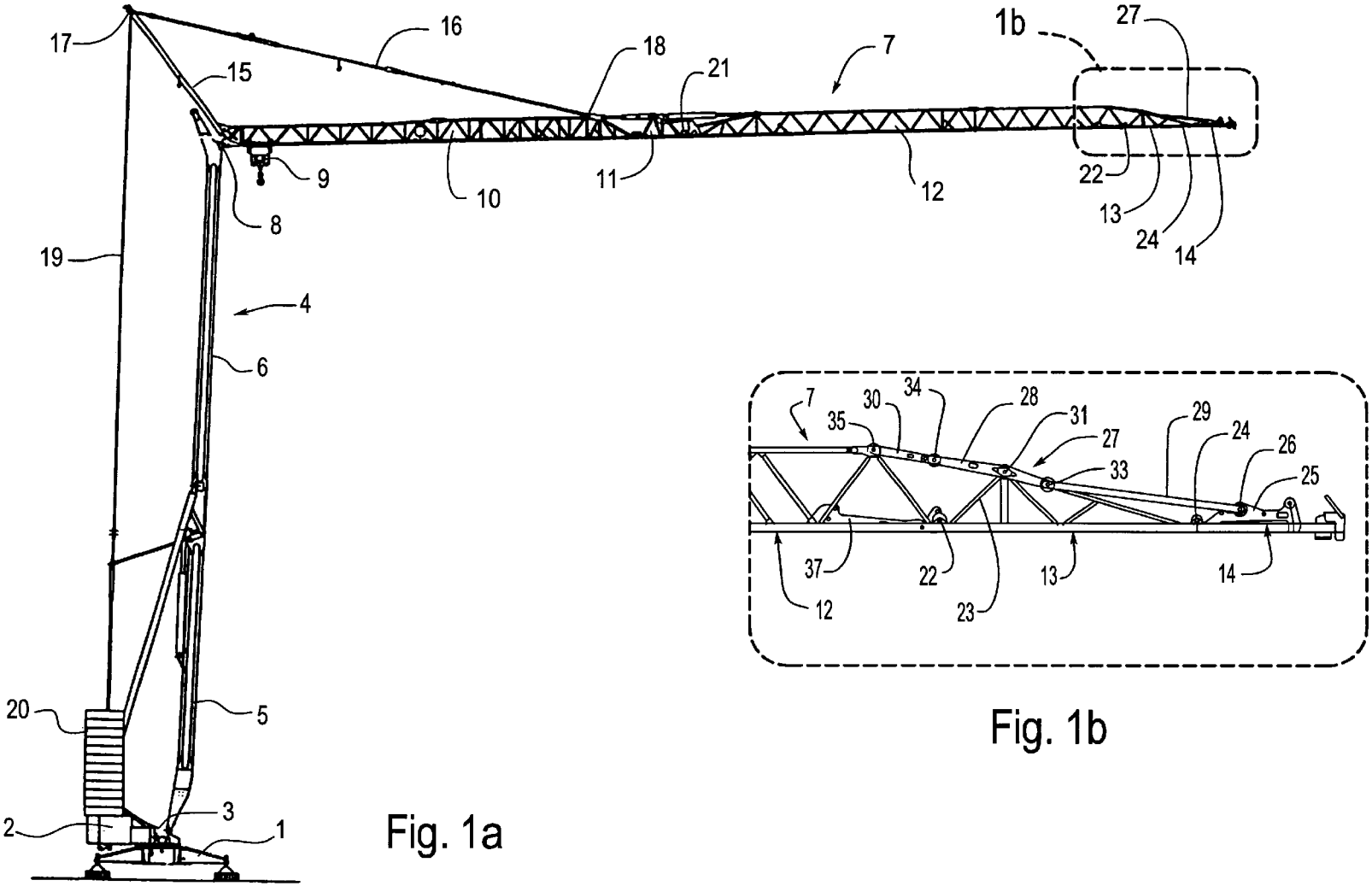
FIG. 1 is an overall side view of a tower crane equipped with the device that is the subject of the invention, with an enlarged detail of the jib tip, the crane being in the deployed work position.

The tower crane depicted in FIG. 1 comprises a base chassis 1 which, via an orientation mechanism, supports a revolving chassis 2 to which there is articulated, about a horizontal axis 3, a folding mast 4 made up of a lower mast element 5 and of an upper mast element 6. The upper mast element 6 bears, at its top, a delivery crane jib 7 articulated about a horizontal axis 8 at the top of the upper mast element 6. The jib 7, which when aligned constitutes the runway for a crab 9 is itself made up, from rear to front, of a relatively long first main jib element 10, of a relatively short intermediate jib-folding element 11, of a relatively long second main jib element 12, of a relatively short first jib tip element 13, and of a relatively short second jib tip element 14 which constitutes the end element of the jib 7. All these jib elements 10 to 14 are articulated one to the next about horizontal axes and, when the crane is in the work position (FIG. 1), are aligned to form the runway for the crab 9.

Articulated to the base of the first main jib element 10, also known as the jib root, is a rigid jib stanchion 15, which is inclined toward the rear of the crane in the work position. A jib tie rod 16 connects the top 17 of the jib stanchion 15 to a point 18 on the top member of the jib root 10. A jib-retaining tie rod 19 connects the top 17 of the jib stanchion 15 to the revolving chassis 2 which also carries ballast 20.

Motorized means 21 of the ram type are associated with the intermediate jib-folding element 11, to allow the second main jib element 12 to be folded onto the first main jib element 10.

Figure 3:
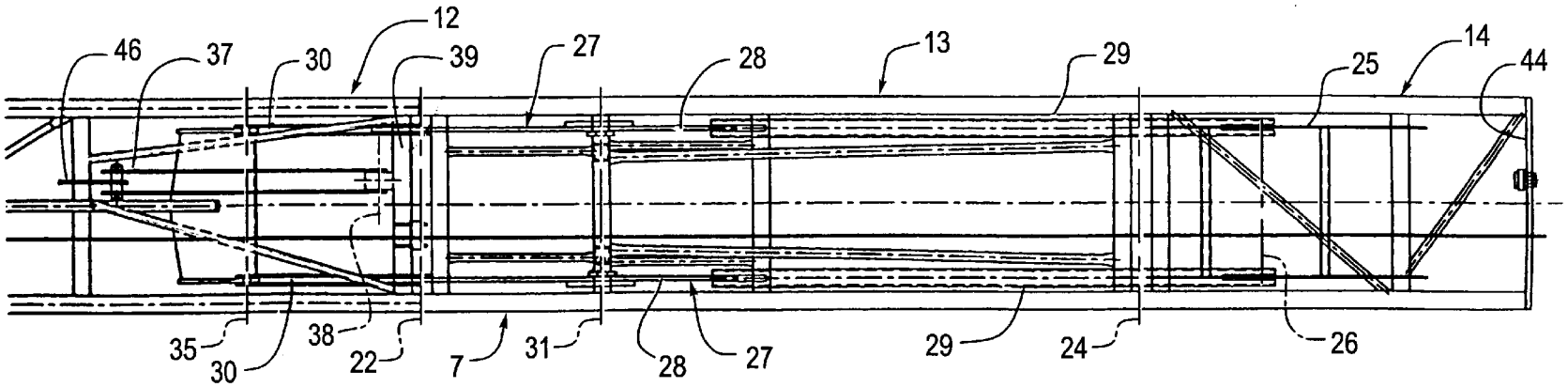
FIG. 3 is a plan view, from above, of the jib tip.
Figure 5:
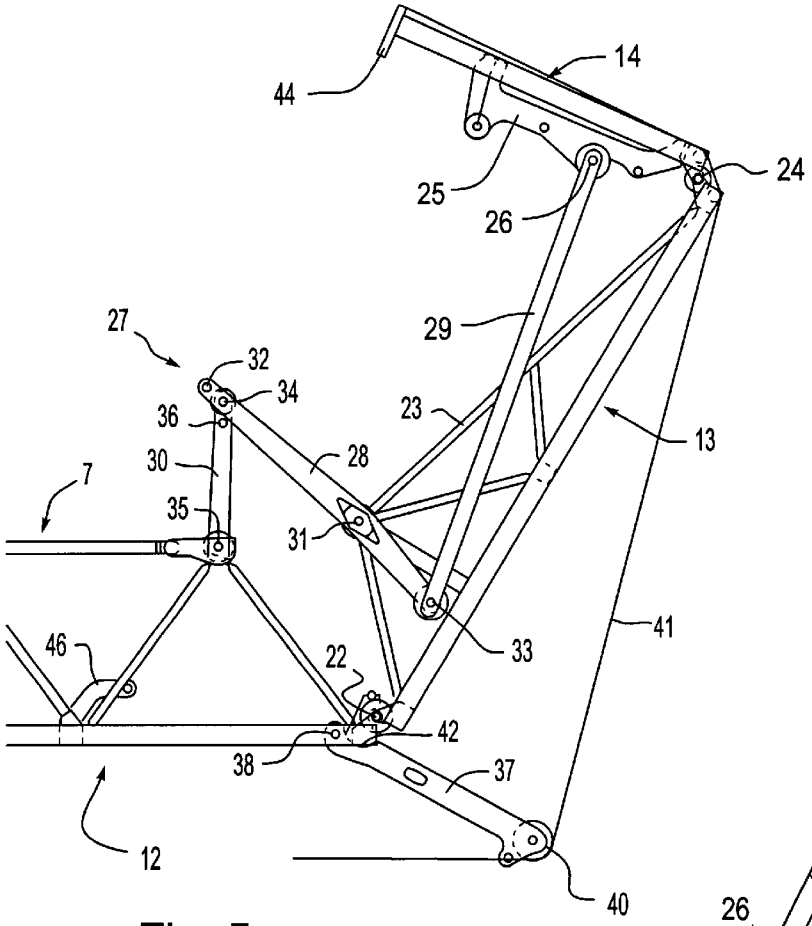
FIGS. 4, 5, 6, and 7 are side views of this jib tip in positions occupied in succession while it is being unfolded.
Figure 4:
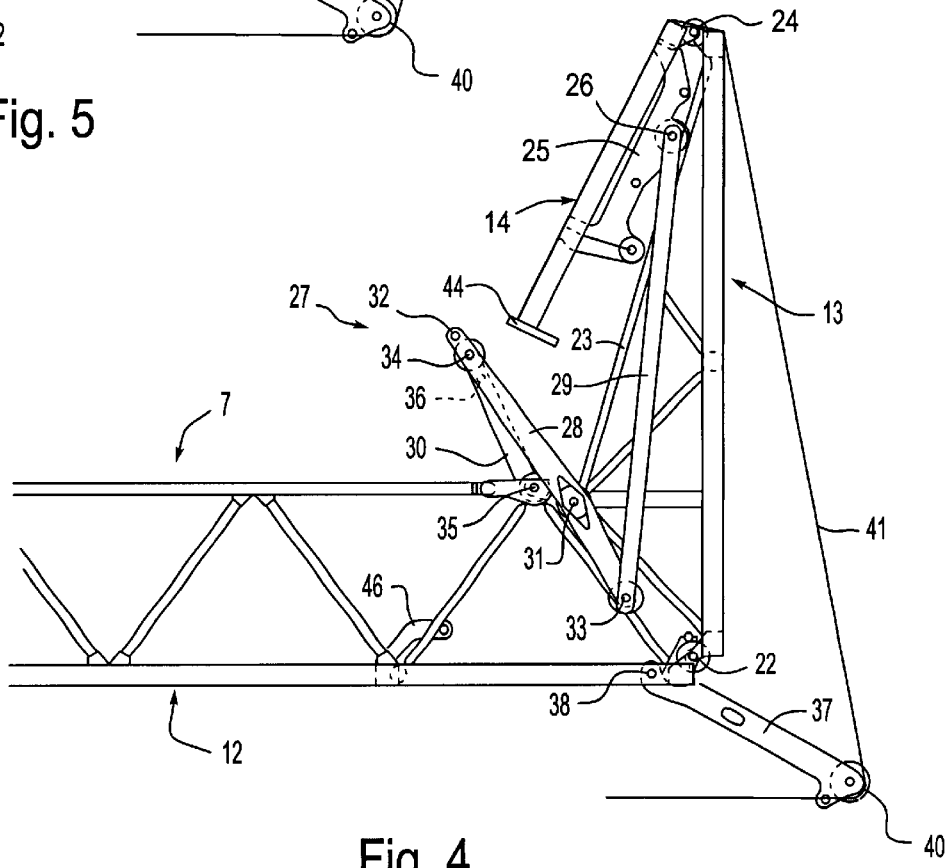
Figure 6:
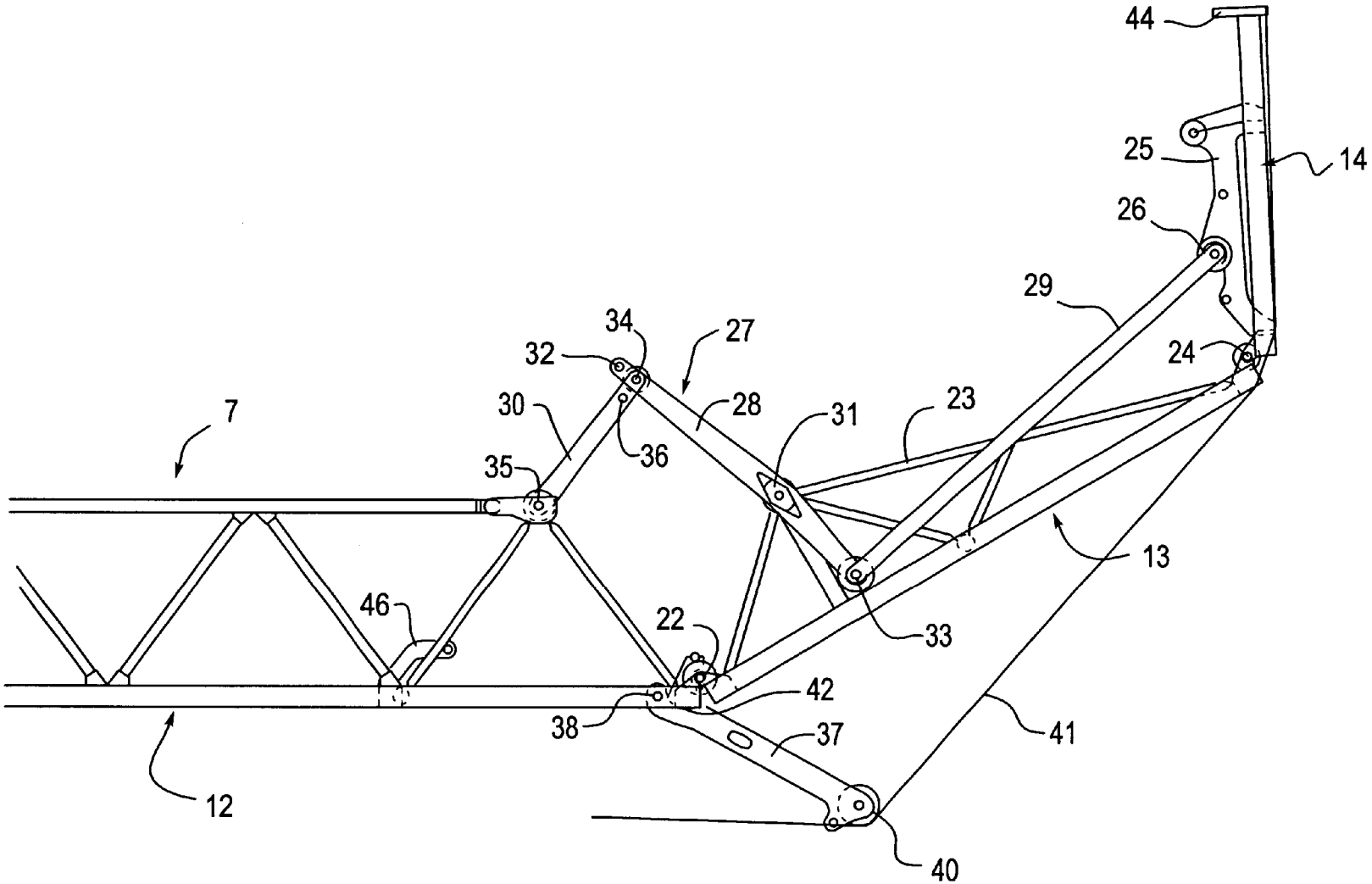
Figure 7:
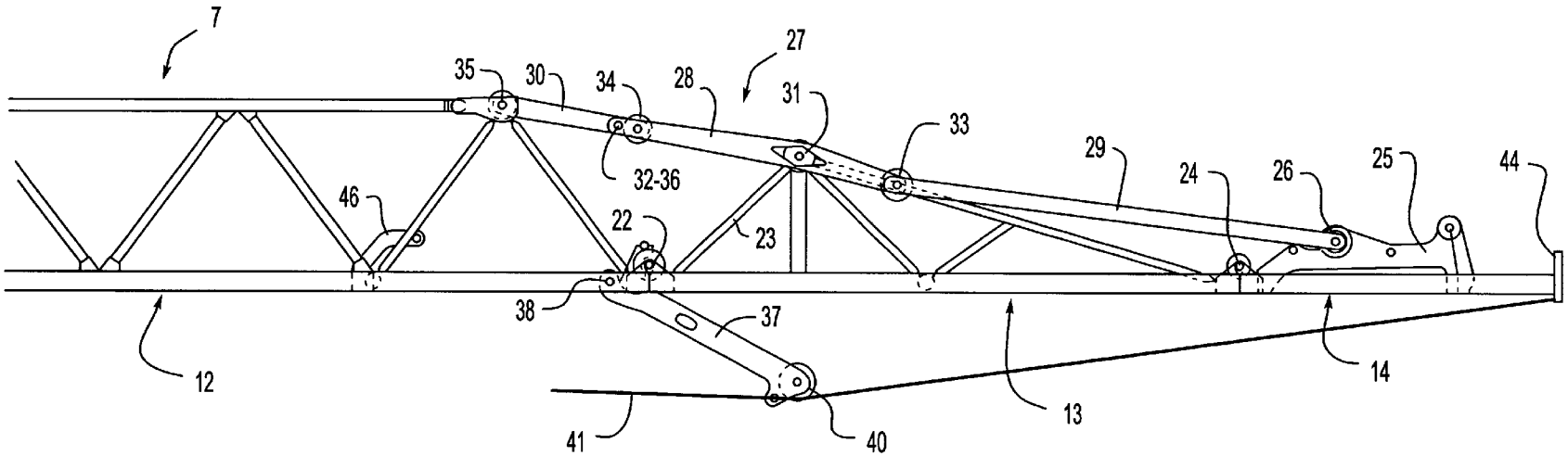

The region of most particular interest here is the region of the tip of the jib 7, which comprises two relatively short jib elements 13 and 14 clearly visible in the enlarged detail of FIG. 1 and in FIG. 3 et seq.

The jib tip element 13, which is an intermediate element, is articulated to the front end of the second main element 12 about a horizontal axis 22. This articulation can be achieved, on each side of the jib 7, using a yoke-tang system, the yoke being located, for example, on the intermediate element 13, while the tang belongs to the main jib element 12. The intermediate element 13 has, when viewed from the side, triangular appearance defining a top or vertex 23.

The second jib tip element 14, which is the end element, is itself articulated to the front end of the intermediate element 13 about another horizontal axis 24. This articulation too can be achieved on each side of the jib 7 using a yoke-tang system, the yoke being located, for example, on the end element 14, while the tang is located on the intermediate element 13. The end element 14 is essentially straight but also includes lateral structures 25 defining a horizontal articulation axle 26.

The unfolding/folding device intended for the two jib tip elements 13 and 14 comprises two link-rod systems 27 arranged symmetrically one on each side of the jib 7, in parallel vertical planes. Each link-rod system 27 is made up of a lever 28, a front connecting rod 29 and a rear connecting rod 30.

The lever 28, which is a three-point lever, is articulated by its intermediate point to the top 23 of the intermediate jib tip element 13 about a horizontal through-axle 31. This lever 28 at its rear end comprises a hole 32, intended for locking it in the work position.

The front connecting rod 29 is articulated by one end to the front articulation point 33 of the lever 28, about a horizontal axis. At its other end, the front connecting rod 29 is articulated to the end jib tip element 14 about the aforementioned horizontal axle 26.

The rear connecting rod 30 is articulated by one end to the rear articulation point 34 of the lever 28, about a horizontal axis. At its other end, the rear connecting rod 30 is articulated, about a horizontal axis 35, to the front of the main jib element 12. This connecting rod 30 has a hole 36 for locking it in the work position.

The unfolding/folding device also comprises an unfolding arm 37 articulated about a horizontal axis 38 on a cross member 39 (see FIG. 3) secured to the front of the main jib element 12. The unfolding arm 37 has, at its free end, a pulley 40 over which the lifting cable 41 can pass. This arm 37 has a V-shaped cut-out 42, allowing it to rest on the cross member 39 in the use position (for unfolding and folding the jib tip elements 13 and 14). The unfolding arm 37 also includes means for locking it, by pinning, in the transport position, in which position it is folded against the main jib element 12.

The unfolding/folding device also comprises a sling 43 (see FIG. 2) fixed by loops to the front cross member 44 of the end jib tip element 14 and intended to be attached (in the folded transport position) to the rear end of the jib root 10.

The movements of the device are motorized, on the one hand, by means of the lifting cable 41, the end of which is fixed by a shackle to the front end of the end jib element 14 and, on the other hand, by means of the ram 21 associated with the intermediate folding element 11 and which performs the overall unfolding/folding of the jib 7.

Figure 2:
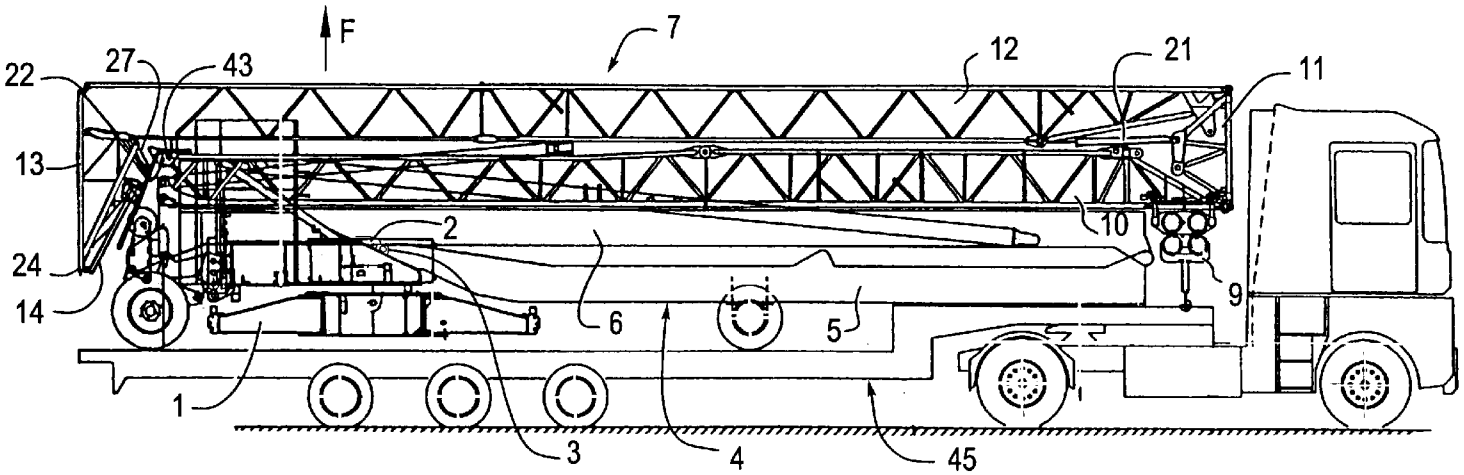
FIG. 2 depicts the same crane, viewed from the side, in the folded transport position.

When the crane is in the transport position, as shown in FIG. 2, this crane is loaded onto a plant-carrying semitrailer 45 belonging to a road haulage unit comprising bobtail and semitrailer. The mast elements 5 and 6 are arranged horizontally, as are the two main elements 10 and 12 of the jib 7, all these elements being superposed. The intermediate folding element 11 occupies a vertical position at the front of the semitrailer 45. The jib tip is at the rear of the semitrailer 45, the intermediate element 13 being roughly vertical (therefore perpendicular to the main elements 10 and 12) and pointing downward, while the end element 14 is oriented obliquely, pointing upward and forward. The unfolding arm 37, folded down against the main jib element 12, is locked to a lug 46 secured to this element 12.

Starting from this folded transport position of the crane, the two jib tip elements 13 and 14 are unfolded in a lowered position, in a way described hereinafter with reference to FIGS. 4 to 7.

First of all, "slack" is created in the lifting cable 41, by operating its winch.

The unfolding arm 37 is then unlocked by removing the pin, and is then pivoted manually into the raised position of use, resting against the cross member 39. The lifting cable 41 is then run over the pulley 40 of the unfolding arm 37.

By operating the ram 21 for the overall unfolding/folding of the jib 7, the jib 7 is unfolded by a small angle, for example of the order of 5°, as suggested by arrow F in FIG. 2, so as to slightly raise the main element 12 and the jib tip region and allow the sling 43 to come clear of the rear end of the jib root 10.

Tension is then reapplied to the lifting cable 41, which then pulls on the front end of the end jib tip element 14 and actuates the two link-rod systems 27, thus simultaneously extending the angle between the front element 14 and the intermediate element 13 of the jib tip and the angle between the intermediate element 13 and the second main element 12 of the jib. The movement thus initiated is continued until the jib elements 12, 13, and 14 are fully aligned—see the intermediate positions of FIGS. 5 and 6, and the final position of FIG. 7.

The jib 7 is then folded, using the ram 21, to return the main element 12 to its initial low position, the jib tip now being aligned with this main element 12.

On each link-rod system 27, the lever 28 is locked to the rear connecting rod 30 by introducing a pin through the holes 32 and 33 which are now aligned. This locking immobilizes the front connecting rod 29 and therefore immobilizes the entire link-rod system 27 in the aligned position.

Finally, the lifting cable 41 is relaxed and this releases the unfolding arm 37 which is manually folded down into the transport position and locked to the main element 12 of the jib 7.

The folding of the two jib tip elements 13 and 14 to allow the crane to be returned to the transport position is performed in the reverse order to the order of unfolding operations described previously, the only exception being that near to the end of unfolding the sling 45 is attached manually to the rear end of the jib root 10.

It would not be departing from the scope of the invention as defined in the appended claims;

if the details of the link-rod systems were to be modified, for example, if a single link-rod system were to be provided in place of a double one, or if other members were to be provided for connecting the two jib tip elements and the last main element of this jib;

if the invention were to be applied to the jib of a tower crane with a telescopic mast rather than a folding mast.

What is claimed is:

1. A device for folding or unfolding tower crane jib tip elements, the jib having a succession of elements articulated one to the next about horizontal axes, these elements including at least first and second relatively long main elements, the first main element being a jib root, an intermediate jib element, and at least two relatively short first and second tip elements, the device comprising:

an unfolding arm borne by a front part of the second main jib element;

a pulley fitted to the unfolding arm, wherein a lifting cable of the crane passes over the pulley to provide motorization during the operations of unfolding and folding of the jib tip elements, the lifting cable being attached to one of the the tip elements; and connecting members connecting a front part of the second main jib element, the first jib tip element and the second jib tip element in such a manner that the first and second jib tip elements can be unfolded or folded simultaneously, in a vertical plane, relative to the remaining elements of the jib, at least one tip element being foldable in a direction approximately perpendicular to the main elements.

2. The device as claimed in claim 1, wherein the connecting members comprise at least one link-rod system located in a vertical plane and connected by articulations about horizontal axes to, respectively, the first and second tip elements and the front part of the second main jib element, the link-rod system including a lever, a front connecting rod, a rear connecting rod, and articulation points relating the connecting rods and lever to one another.

3. The device as claimed in claim 2, which comprises two symmetric link-rod systems, arranged one on each side of the jib in parallel vertical planes.

4. A device as claimed in claim 2, wherein the at least one link-rod system comprises a three-point lever articulated by its intermediate point to a top of the intermediate jib tip element, a front connecting rod articulated by one end to the front point of the lever and, by its other end, to the end element of the jib tip, and a rear connecting rod articulated by one end to the rear point of the lever and, by its other end, to the front part of the last main jib element.

5. The device as claimed in claim 4, wherein the lever and one of the connecting rods of the or of each link-rod system comprise respective holes which come into alignment when the jib tip is in the unfolded position, and which are designed for locking using a pin which immobilizes the lever with respect to this connecting rod and which consequently immobilizes the entire link-rod system in the aligned position.

6. A device as claimed in claim 1, wherein the unfolding arm is articulated about a horizontal axis to the front part of the last main jib element and includes stop and/or locking means for stopping it in the deployed position of use and in the position in which it is folded up against the main jib element.

7. A device as claimed in claim 1, wherein, for the operations of unfolding or folding the jib tip elements, the lifting cable is attached to a shackle at the front end of the end jib element.

8. A device as claimed in claim 7, which also comprises a sling fixed to the front part of the end jib tip element and is designed to be attached to the rear end of the first main jib element when this jib is entirely folded.

9. A device as claimed in claim 1, which is furthermore motorized by a ram used for the overall unfolding/folding of the jib, particularly a ram associated with an intermediate folding element inserted between two main jib elements, the ram allowing the last main jib element to be inclined slightly and raised so as to bring the jib tip elements clear of the rear end of the jib root and allow these tip elements to be unfolded.

10. A device as claimed in claim 1, wherein, when the crane is in the folded transport position, with the main jib elements arranged horizontally, the intermediate jib tip element is approximately vertical and points downward, while the end jib tip element is oriented obliquely, and points upward.

* * * * *